United States Patent [19]

Janzen

[11] 4,190,211

[45] Feb. 26, 1980

[54] REEL MOUNTING APPARATUS

[76] Inventor: Harlo W. Janzen, Rte. 2, Box 74, Balko, Okla. 73931

[21] Appl. No.: 949,815

[22] Filed: Oct. 10, 1978

[51] Int. Cl.[2] ..... B65H 75/40

[52] U.S. Cl. ..... 242/86.7; 242/86.5 R; 242/99

[58] Field of Search ..... 242/86.5 R, 86.7, 99, 242/156, 156.2

[56] References Cited

U.S. PATENT DOCUMENTS

| | | | |
|---|---|---|---|
| 327,196 | 9/1885 | Roberts | 242/86.7 |
| 2,213,764 | 9/1940 | Hermann | 242/156.2 |
| 2,214,315 | 9/1940 | Adamson | 242/86.7 |
| 2,743,883 | 5/1956 | Farmer | 242/86.5 R |
| 3,128,962 | 4/1964 | Bieber | 242/86.5 R |
| 3,248,068 | 4/1966 | Slepicka | 242/86.7 |

*Primary Examiner*—Edward J. McCarthy
*Attorney, Agent, or Firm*—William R. Laney

[57] ABSTRACT

Apparatus for mounting a reel of wire on a truck bed, which apparatus includes a pair of brackets mountable at opposite sides of the bed and adapted to support an elongated shaft assembly at spaced locations therealong, a shaft assembly extending between and supported by the brackets, and a friction braking assembly movably mounted on the shaft assembly for movement axially on the shaft assembly. The friction braking assembly includes a rotatable friction element adapted to be keyed to a reel rotatably supported on the shaft assembly between the brackets, a second friction element movable axially on the shaft assembly into and out of engagement with the rotatable friction element, and means for adjustably and resiliently urging the second friction element into frictional engagement with the rotatable friction element. A reel positioning plate and sleeve assembly is slidably mounted on the shaft assembly for retaining a reel in engagement with the rotatable friction element.

13 Claims, 6 Drawing Figures

REEL MOUNTING APPARATUS

BACKGROUND OF THE INVENTION

1. Field of the Invention

This invention relates to apparatus and devices for mounting large wire-carrying reels on a truck for paying the wire from the reel as the truck is driven. More particularly, the invention relates to a reel mounting apparatus for mounting a reel of wire on a truck and paying the wire out from the reel during movement of the truck in a way in which no backlash or overrun of the reel occurs during the payout.

2. Brief Description of the Prior Art

In Slepicka U.S. Pat. No. 3,248,068, a wire winding apparatus is illustrated and described which includes a device for applying rotary drive pressure to the ends of a spool by means of pressure plates. The spool is a flanged cylinder and the pressure plates are positioned against the flanges at opposite ends of this cylinder. A spring bears against one of the pressure plates in such a manner that the tension in that spring may be adjusted to adjust the amount of drag applied to the spool as a wire is unwound therefrom.

U.S. Pat. No. 2,214,315 to Adamson depicts a reel braking device in which a braking action is effected by causing cam surfaces to move relative to each other, thereby moving a braking pad into engagement with a pad carried on the reel.

Other patents have previously been issued on the concept of preventing wire backlash on a wire winder or reel.

BRIEF DESCRIPTION OF THE PRESENT INVENTION

The present invention provides an apparatus for mounting a reel of wire on a truck bed in such way that wire from the reel can be unwound in a controlled fashion. The apparatus for mounting the reel on the bed includes an elongated shaft assembly which is supported at opposite sides of the bed, and a friction braking assembly movably mounted on the shaft assembly for movement axially on the shaft assembly. The friction braking assembly includes a rotatable friction element adapted to be keyed to a reel rotatably supported on the shaft assembly between the brackets, and a second friction element which is movable axially on the shaft assembly into and out of engagement with the rotatable friction element. Means is provided for adjustably and resiliently urging the second friction element into frictional engagement with the rotatable friction element. A reel positioning plate and sleeve assembly is slidably mounted on the shaft assembly for retaining a reel in engagement with the rotatable friction element.

An important object of the present invention is to provide a reel mounting apparatus by which a reel of barbed wire or other wire can be quickly mounted and demounted on the bed of a pickup truck, using the existing stake wells or flanges at opposite sides of the bed to achieve anchoring of the reel mounting apparatus.

Another object of the invention is to provide a reel mounting apparatus which includes an adjustable braking assembly which can be used for adjusting the amoung of drag applied to a reel or drum as wire is being payed therefrom so as to prevent overrun and backlash.

A further object of the invention is to provide a reel mounting apparatus which is relatively simple in its mechanical constitution, and is characterized in having a long and trouble-free operating life.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF PREFERRED EMBODIMENTS OF THE INVENTION

Figure 1:
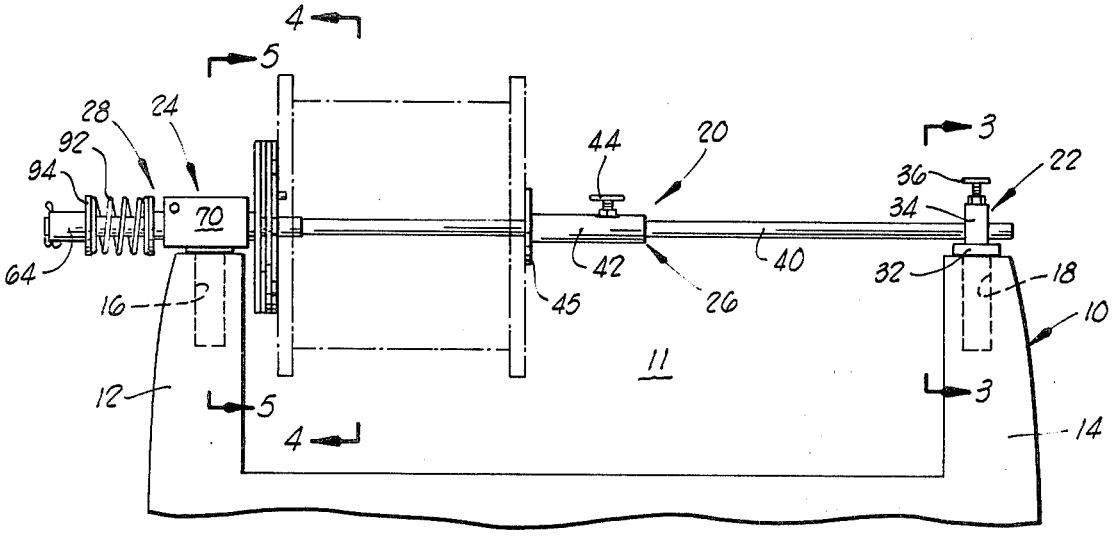
FIG. 1 is a rear elevation view of the reel mounting apparatus of the invention as it appears when mounted upon the bed of a pickup truck, and illustrating, in dashed lines, the reel supported by the apparatus.

Referring initially to FIG. 1 of the drawings, the bed of a pickup truck, as it appears when viewed from the rear, is designated generally by reference numeral 10. The bed is open at the center, as shown at 11, and includes a pair of upwardly extending sides 12 and 14.

As is characteristic of many types of the side walls provided on opposite sides of the bed of a pickup truck, stake wells are provided in the form of cavities formed downwardly into the side walls from the upper edge thereof. Such stake wells are shown in dashed lines in FIG. 1 of the drawings, and are designated by reference numerals 16 and 18.

The reel mounting apparatus of this invention is illustrated as it is mounted upon the truck bed 10 and is designated generally by reference numeral 20. The reel mounting apparatus 20 includes a pair of bracket subassemblies 22 and 24. The apparatus further includes an elongated shaft assembly 26, and a friction braking assembly 28 which is movably mounted on the shaft assembly 26.

Figure 3:
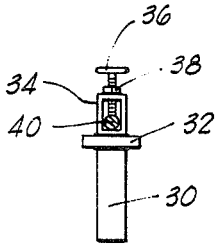
FIG. 3 is a sectional view taken along line 3—3 of FIG. 1.

The shaft assembly 26 is supported at one of its ends in the bracket subassembly 22. The bracket subassembly 22, as best shown in FIG. 3, includes a downwardly projecting stake 30 which is dimensioned for insertion in the stake well 18 at the right of the truck bed 10. At the upper end of the stake 30, a stop flange 32 is provided and a substantially rectangular collar 34 is secured to the upper side of the flange. A clamping bolt 36 is threaded through a threaded nut 38 secured to the upper side of the collar 34.

The clamping bolt 36 is used to engage one end portion **40*a* of an elongated shaft element 40. At its opposite end, the shaft element 40 is necked down to a reduced diameter at an end portion 40*b*. Slidably mounted upon the shaft element 40 is a tubular reel locking collar 42. The reel locking collar 42 carries a headed locking screw 44 which is threaded through the peripheral wall of the collar to facilitate engagement with the end portion 40*a* of the shaft element 40**. A reel clamping plate 45 having a central aperture 47 therein dimensioned to surround the shaft 40 is mounted on the shaft adjacent the collar 42.

Figure 4:
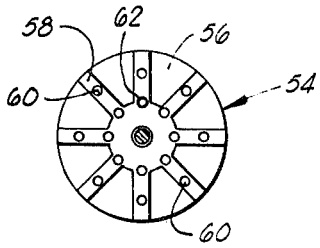
FIG. 4 is a sectional view taken along line 4—4 of FIG. 1.

The shaft assembly 26 further includes a telescoping shaft extension 46 which has a bore 48 formed in one end thereof for receiving the reduced diameter end portion 40*b* of the shaft element 40. At its other end, the shaft extension 46 has a plurality of threads 50 formed therearound, and defines a transverse slot 52 which extends diametrically across the end of the shaft extension at this location. Keyed or secured to the shaft extension 46 is a reel engaging friction element or disc plate 54. The friction element 54 includes a circular disc plate 55 and a plurality of radially extending spokes 58 located adjacent the outer periphery of the disc plate 54. Each of the spokes 58 has an aperture 60 formed therein as shown in FIG. 4. One or more engaging lugs 62 may be inserted in one or more of the apertures 60 for engagement with the end plate of a wire reel in a manner hereinafter described.

The shaft extension 46 of the shaft assembly 20 projects through the friction braking assembly 28 as hereinafter described in detail, and engages at its threaded end, an internally threaded collar 64 which is slotted, as shown at 66, to permit a cotter pin 68 to be extended through the slot and through the opening formed in the end of the shaft extension 46.

The friction braking assembly 28 is movably mounted on the shaft assembly 20 for axial movement therealong, and is also movably supported in the bracket subassembly 24. The bracket subassembly 24 includes an elongated collar channel 70 which is secured to a flange 72 welded or otherwise secured to the upper end of a stake 74. The stake 74 is insertable in the stake well 16 to permit the bracket subassembly 24 to be mounted upon the bed 10 of the pickup truck. A retention bolt 76 is extended through opposite side flanges of the channel collar 70 near the upper side of the channel collar, and functions to retain an elongated sleeve 80 forming a part of the friction braking assembly 28 in the channel collar as hereinafter described in greater detail.

Figure 2:
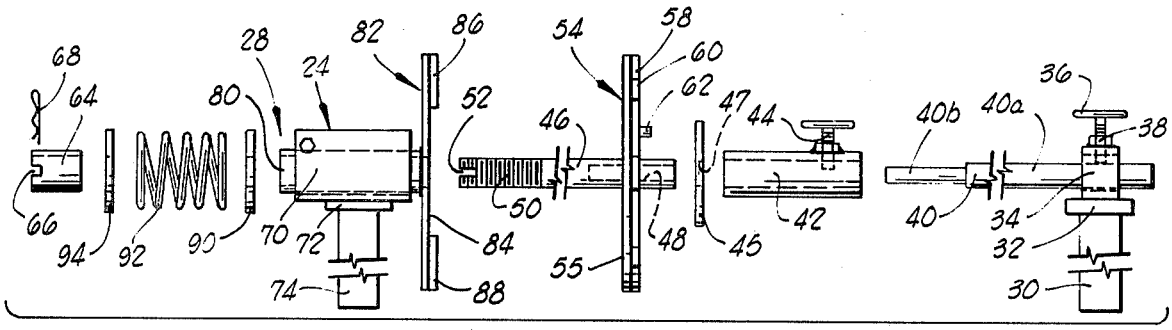
FIG. 2 is an exploded view of the reel mounting apparatus of the invention with some portions of the apparatus broken away for clarity of illustration.
Figure 5:
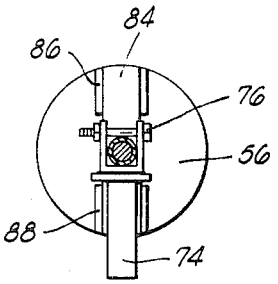
FIG. 5 is a sectional view taken along line 5—5 of FIG. 1.

The friction braking assembly 28, in addition to the sleeve 80, includes a friction element 82 which comprises a cross-piece 84 having a pair of friction pads 86 and 88 secured to the opposite ends thereof. (See FIGS. 2 and 5.) As previously described, the sleeve 80 extends through the collar channel 70. At its end opposite that end which carries the friction element 82, the sleeve 80 bears against a centrally apertured, disc-shaped spring abutment plate 90 which closely surrounds, but is not keyed to, the shaft extension 46. A helical compression spring 92 surrounds the shaft extension 46 and has one of its ends bearing against the spring abutment plate 90 and its other end bearing against a second spring abutment plate 94. The second spring abutment plate 94 abuts the threaded collar 64 and is prevented from moving outwardly toward the end of the shaft extension 46 by this collar.

Operation

In the use and operation of the reel mounting apparatus of the invention, the several parts of the apparatus as hereinbefore described are assembled in the manner shown in FIG. 1 of the drawings. Thus, the reel mounting apparatus 20 is mounted across the opening 11 in the bed 10 of the pickup truck so that the elongated shaft assembly 26 extends substantially horizontally and is supported at its opposite ends in the bracket subassemblies 22 and 24. In this arrangement, and in the course of assembling the apparatus, the elongated shaft element 40 is extended through a cylindrically configured drum carrying wire in the manner in which such drums are conventionally made up. The shaft element 40 is extended through the drum by initially placing the reduced diameter end portion 40*b* through the opening in the central portion of the drum.

At this time, the reel engaging friction element 54 is positioned on that side of the drum opposite the side through which the reduced diameter end portion 40*b* of the shaft is first extended. The tubular reel locking collar 42 and clamping plate 45 are, however, kept relatively closely adjacent to the bracket subassembly 22 until the reel has been mounted in the illustrated position. The reel is pushed down the shaft element 40, after the shaft element has been passed therethrough until it abuts the reel engaging friction element 54. When the reel is in this position, the engaging lugs 62 are used to effect an interlocking engagement between the radially extending spokes 58 of the reel engaging friction element and the flat disclike end face of the reel. The reel is thus keyed to the reel-engaging friction element 54 so that the two will rotate together.

After engagement of the reel with the reel-engaging friction element 54 by use of the engaging lugs 62 extended between mating apertures in the reel face and the aperture 60 in the spokes 58, the tubular reel locking collar 42 is slid down the elongated shaft element 40 and is used to force the clamping plate 45 into clamping engagement with the opposite side of the reel from the reel engaging friction element 54. When the reel is clamped firmly between the clamping plate 45 and the reel engaging friction element 54, the headed locking screw 44 is screwed down into tight engagement with the periphery of the shaft 40. The reel is now mounted rotatably on the shaft element 40, and is secured against any axial movement on the shaft.

Prior to commencing unreeling wire from the reel, the pressure with which the friction element 82 bears against the reel engaging friction element 54 is adjusted by adjusting the distance which the internally threaded collar 64 is threaded upon the threaded end 50 of the shaft extension 46. The collar 64 is then locked in its adjusted position by means of the cotter key 68. The position of the collar 64 on the shaft extension 46 will determine the amount of compression of the helical compression spring 92, and this will in turn determine the force with which the friction element 82 is drawn against the reel engaging friction element 54. It will be noted that this engagement consists of the friction pads 86 and 88 carried on opposite ends of the cross piece 84 and making frictional contact with the circular disc plate 55 forming a part of the reel engaging friction element 54. This frictional contact is maintained during the time that the reel is undergoing rotation, and exerts a drag or braking force acting upon the circular disc plate 55 of the reel engaging friction element 54 so as to slow its rotative movement and prevent overrunning and backlash.

As wire is paid off of the reel, the reel, of course, undergoes rotation. At this time, however, rotational motion of the reel is opposed by the frictional drag forces transferred to the circular disc plate 55 of the reel engaging friction element from the friction pads 86 and 88 carried on the cross piece 84 of the friction element 82. The amount of this drag, or the magnitude of the force braking the turning of the reel, can be adjusted in the manner previously described, so that, where very rapid unreeling of wire from the reel is being carried out, the braking force will still be adequate to prevent overrunning of the reel due to inertia.

Figure 6:
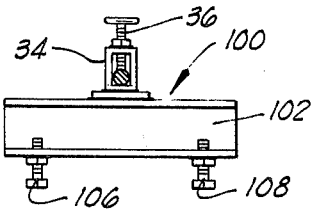
FIG. 6 is a view in elevation of an alternate embodiment of a supporting bracket that can be used as a portion of the reel mounting apparatus of the invention.

In some vehicles, instead of the stake wells 16 and 18 shown as being utilized to support the brackets 22 and 24, the sides of the bed 10 of the truck will be turned over or flanged so that a channel type bracket base is needed, rather than brackets carrying stakes for registry with the stake wells. In such instance, a bracket of the type shown in FIG. 6, and designated generally by reference numeral 100, may be utilized in place of the type a stake well mounting bracket 22 of the sort shown in FIGS. 1 and 3. Here, an elongated channel element 102 of C-shaped configuration is provided for receiving and clamping over the flange formed at the upper sides of each side of the bed of the pickup truck. After the channel element 102 has been placed over this flange, a pair of locking screws 106 and 108 are tightened to secure the bracket 100 in position. In other respects, the bracket 100 shown in FIG. 6 is constructed similarly to the bracket shown in FIG. 3, and thus includes the substantially rectangular collar 34 and the clamping bolt 36.

Although a preferred embodiment of the invention has been herein described and the principles of operation have been discussed by reference to such preferred embodiment, it will be understood that the basic principles of the invention can be embodied in other physical forms and arrangements. It is therefore contemplated that such rearrangements of form and structure as may be carried out without departure from such basic principles, and as will be readily apparent to those skilled in the art, are deemed to be circumscribed by the spirit and scope of the invention except as the same may be necessarily limited by the appended claims or reasonable equivalents thereof.

What is claimed is:

1. A reel mounting apparatus comprising:
- a pair of bracket subassemblies adapted for securement to the vertically extending sides of a truck;
- an elongated, two-part shaft assembly including
  - a shaft detachably mounted in one of said bracket subassemblies; and
  - a shaft extension detachably coupled to said shaft and projecting coaxially therefrom;
- a sleeve slidably surrounding said shaft extension, and movably mounted on said other bracket subassembly to facilitate axial movement along the shaft extension;
- a friction element adjacent an end of said sleeve disposed between said brackets and movable therewith on the shaft extension; and
- spring means biasing said sleeve along said shaft extension toward said one bracket subassembly.

2. A reel mounting apparatus as defined in claim 1 and further characterized as including means for retaining a reel on said shaft assembly at a location in which it is adjacent said friction element.

3. A reel mounting apparatus as defined in claim 1 and further characterized as including
- a second friction element; and
- means for keying said second friction element to a reel for rotation therewith about the axis of said shaft.

4. A reel mounting apparatus comprising:
- an elongated shaft assembly;
- means for mounting the shaft assembly in a horizontal attitude across a truck bed;
- a friction braking assembly movably mounted on the shaft assembly for axial movement therealong;
- means for positioning a reel on said shaft assembly at a location adjacent said friction braking assembly; and
- a friction element on said shaft assembly and engageable with the end face of a wire reel and with said friction braking assembly.

5. A reel mounting apparatus comprising:
- an elongated shaft assembly;
- means for mounting the shaft assembly in a horizontal attitude across a truck bed;
- a friction braking assembly movably mounted on the shaft assembly for axial movement therealong, said friction breaking assembly comprising a sleeve slidably mounted on said shaft assembly, a friction element secured to said sleeve, and means for resiliently urging said sleeve comprising
  - an abutment plate bearing against one end of said sleeve and surrounding said shaft assembly;
  - a coil spring around said shaft assembly and having an end bearing against said abutment plate; and
  - means retaining the end of said spring opposite said first mentioned end thereof at a fixed location along said shaft; and
- means for positioning a reel on said shaft assembly at a location adjacent said friction braking assembly.

6. A reel mounting apparatus comprising:
- an elongated shaft assembly which is severable into two parts including a shaft and a shaft extension telescopingly engageable with said shaft to facilitate extension of said shaft assembly through an open-centered reel;
- means for mounting the shaft assembly in a horizontal attitude across a truck bed;
- a friction braking assembly movably mounted on the shaft assembly for axial movement therealong, said friction braking assembly comprising a sleeve slidably mounted on said shaft assembly, a friction element secured to said sleeve, and means for resiliently urging said sleeve and said friction element in an axial direction along said shaft assembly;
- means for positioning a reel on said shaft assembly at a location adjacent said friction braking assembly, said means for positioning a reel on said shaft assembly comprising a reel locking collar slidably mounted on said shaft assembly and a reel clamping plate.

7. A reel mounting apparatus as defined in claim 6 and further characterized as including a friction element on said shaft assembly and engageable with the end face of a wire reel and with said friction braking assembly.

8. A reel mounting apparatus as defined in claim 7 wherein said means for resiliently urging said sleeve comprises:
- an abutment plate bearing against one end of said sleeve and surrounding said shaft assembly;
- a coil spring around said shaft assembly and having an end bearing against said abutment plate; and
- means retaining the end of said spring opposite said first-mentioned end thereof at a fixed location along said shaft.

9. A reel mounting apparatus comprising:
- an elongated shaft assembly which is severable into two parts including a shaft and a shaft extension telescopingly engageable with said shaft;

means for mounting the shaft assembly in a horizontal attitude across a truck bed;

a friction braking assembly movably mounted on said shaft assembly for axial movement therealong; and means for positioning an open-centered reel on said shaft assembly at a location adjacent said friction braking assembly and such that when said shaft is telescopingly removed from said shaft extension an open-centered reel can be mounted thereon.

10. A reel mounting apparatus as defined in claim 9 wherein said means for mounting the shaft assembly across a truck bed comprises first and second bracket subassemblies each engageable with a side of said truck bed, said first bracket subassembly retaining said shaft and said second bracket subassembly retaining said shaft extension.

11. A reel mounting apparatus as defined in claim 10 wherein each of said bracket subassemblies includes:

a stake to be rotatably received in a stake well in a side of said truck bed; and means secured to the stake for receiving a portion of said shaft assembly therethrough.

12. A reel mounting apparatus as defined in claim 9 wherein said means for positioning a reel on said shaft assembly comprises:

a reel locking collar slidably mounted on said shaft assembly; and a reel clamping plate disposed between said reel locking collar and said reel.

13. A reel mounting apparatus as defined in claim 9 wherein said friction braking assembly comprises:

a sleeve slidably mounted on said shaft assembly;

a friction element secured to said sleeve; and means for resiliently urging said sleeve and friction element in an axial direction along said shaft assembly.

* * * * *